US007241190B2

(12) United States Patent
Smyk

(10) Patent No.: US 7,241,190 B2
(45) Date of Patent: Jul. 10, 2007

(54) FEMALE ELECTRICAL TERMINAL AND ELECTRICAL CONNECTOR COMPRISING THE SAME

(75) Inventor: Michael C. Smyk, Mechanicsburg, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 09/989,271

(22) Filed: Nov. 20, 2001

(65) Prior Publication Data

US 2003/0096540 A1 May 22, 2003

(51) Int. Cl.
*H01R 11/22* (2006.01)
*H01R 13/11* (2006.01)

(52) U.S. Cl. ..... 439/852

(58) Field of Classification Search ..... 439/850–856, 439/843, 861, 862, 839
See application file for complete search history.

(56) References Cited

U.S. PATENT DOCUMENTS

| | | | | | |
|---|---|---|---|---|---|
| 4,342,498 | A * | 8/1982 | Patton et al. | ..... | 439/839 |
| 4,880,401 | A * | 11/1989 | Shima et al. | ..... | 439/746 |
| 5,158,485 | A * | 10/1992 | Saito et al. | ..... | 439/843 |
| 5,226,842 | A | 7/1993 | Endo et al. | ..... | 439/843 |
| 5,271,741 | A | 12/1993 | Saito et al. | ..... | 439/843 |
| 5,419,723 | A | 5/1995 | Villiers et al. | ..... | 439/843 |
| 5,476,399 | A | 12/1995 | Porter | ..... | 439/843 |
| 5,643,018 | A * | 7/1997 | Sakai et al. | ..... | 439/852 |
| 5,730,628 | A | 3/1998 | Hawkins | ..... | 439/843 |
| 5,788,542 | A * | 8/1998 | Miwa | ..... | 439/851 |
| 5,873,754 | A | 2/1999 | Hotea | ..... | 439/843 |
| 5,951,338 | A | 9/1999 | Seko et al. | ..... | 439/843 |
| 6,095,874 | A | 8/2000 | Quaranta | ..... | 439/852 |
| 6,139,376 | A | 10/2000 | Ooya et al. | ..... | 439/843 |
| 6,264,508 | B1 | 7/2001 | Lehmann | ..... | 439/843 |
| 6,341,977 | B1 | 1/2002 | Nagai et al. | ..... | 439/397 |
| 6,341,978 | B1 | 1/2002 | Akeda | ..... | 439/397 |
| 6,375,501 | B1 | 4/2002 | Kojima | ..... | 439/595 |
| 6,443,754 | B2 | 9/2002 | Hatagishi et al. | ..... | 439/397 |
| 2003/0096540 | A1 * | 5/2003 | Smyk | ..... | 439/843 |

FOREIGN PATENT DOCUMENTS

| | | |
|---|---|---|
| DE | 197 45 530 | 4/1998 |
| EP | 0 893 850 A2 | 1/1999 |
| EP | 1 209 766 A2 | 5/2002 |
| EP | 1 215 763 A1 | 6/2002 |

OTHER PUBLICATIONS

"Jumbo PV Recept. R/A for .040/1.02 Pin", FCI Electronics, www.fciconnect.com, Drawings, 4 pages.

* cited by examiner

*Primary Examiner*—James R. Harvey
(74) *Attorney, Agent, or Firm*—Woodcock Washburn LLP

(57) ABSTRACT

The present invention relates to female electrical terminals comprising a connection section for connection to a conducting wire and an opposing contact section for mating with a complementary male terminal. A flexible contact element is disposed within at least a portion of the contact section for urging a complementary male terminal into engagement with a contact section wall. The flexible contact element is protected from damage by prohibiting access to its leading edge. The present invention also relates to electrical connectors comprising female electrical terminals.

9 Claims, 6 Drawing Sheets

FEMALE ELECTRICAL TERMINAL AND ELECTRICAL CONNECTOR COMPRISING THE SAME

FIELD OF THE INVENTION

The present invention relates to female electrical terminals and connectors comprising female electrical terminals. The female electrical terminals include protected contact elements for engaging complementary male terminals.

BACKGROUND OF THE INVENTION

A typical electrical connector combination includes a plug connector and a receptacle connector, both of which mount or house interengageable electrical terminals. The plug connector is inserted into or mated with the receptacle connector to interengage the terminals. The terminals may take a variety of configurations, including male and female or pin and socket terminals.

Known female terminals comprise a generally tubular-shaped contact section for engaging a complementary male terminal, and a connection section on the opposing end for connection to a conducting wire. The contact section typically employs flexible elements for applying retentive normal forces to an engaged complementary male terminal. For example, U.S. Pat. No. 6,095,874 discloses an electrical receptacle terminal comprising a contact section having a pair of opposed cantilever beam contact arms. Free ends of the contact arms are resiliently biased toward one another such that their original position defines a space that is of a smaller diameter than a complementary male terminal. The free ends flex outwardly upon insertion of a male terminal, thereby applying normal forces to the male terminal sufficient to maintain the inter-engagement and electrical connectivity.

Many known female terminals employ only a single flexible element in the form of an arcuate-shaped spring housed within the contact section. The spring urges a complementary male terminal into engagement with one of the sidewalls forming the contact section. Ooya et al., in U.S. Pat. No. 6,139,376, disclose such a female terminal, and will now be described with reference to FIGS. 1 and 2. Female electrical terminal 9 includes a contact section 12 and a connection section 14. Contact section 12 is generally box-shaped or rectangular in cross-section and mounts a spring contact element 13 for resiliently gripping a male terminal. As can be seen in the figures, spring contact element 13 has an exposed leading edge 15. Having access to the spring contact element's leading edge, however, is problematic, as it can lead to product damage and/or failure. For example, if a complementary male terminal is misaligned upon engagement with the female terminal, the male terminal can hit the contact element leading edge and damage it. Minimally, the damage results in a non-reliable electrical connection between the inter-engaged terminals. In a worse case scenario, the spring contact element is damaged and distorted to the extent that it becomes separated from the remaining portions of the female terminal. Without the spring contact element, the female terminal will fail.

Quality control related to the manufacture of male and female electrical terminals, as well as related to methods of interengaging the same, may decrease the potential for misaligned engagement; however, the potential for tampering with the contact element, through the use of a small or sharp instrument, still exists when the spring contact element's leading edge is exposed. There have been efforts to reduce the potential for damage to the spring contact element by impeding access to its leading edge, as can be seen from prior art FIG. 3, taken from U.S. Pat. No. 5,271,741. However, the contact element leading edge 18 is still exposed to potential failure-inducing damage.

In summary, the prior art has not been able to come up with functional and robust terminal designs. Accordingly, a need still exists fora female electrical terminal that protects incorporated contact elements from damage.

SUMMARY OF THE INVENTION

The present invention provides improved female electrical terminals. In accordance with a preferred embodiment of the present invention, there has now been provided a female electrical terminal comprising a connection section for connection to a conducting wire and an opposing contact section for mating with a complementary male terminal. The contact section includes a bottom wall, two sidewalls extending upwardly from opposite sides of the bottom wall, and a front end. An entry portion is positioned adjacent the front end, and includes an entrance for guiding a complementary terminal into the contact section. A single flexible contact element is at least partially disposed within the contact section for urging a complementary male terminal into engagement with the bottom wall. The flexible contact element includes a leading edge positioned outside the periphery of the entrance such that access to the leading edge is prohibited.

In accordance with another embodiment, there has now been provided a female electrical terminal similar to that above, wherein some of the contact section front end extends beyond the periphery of the entry portion such that an external opening is formed at the interface between the entry portion and the front end, and the flexible contact element's leading edge extends into the external opening.

In accordance with yet another embodiment, there has now been provided a female electrical terminal comprising a connection section for connection to a conducting wire and a contact section comprising a first tubular portion that forms an insertion pathway for a complementary male terminal, and a second tubular portion between the first tubular portion and the connection section. Central axes of the first and second tubular portions are misaligned such that a space is formed outside of the insertion pathway. A single flexible contact element is at least partially disposed within the contact section for urging an inserted complementary male terminal into engagement with an inner wall of the contact section. The contact element includes a leading edge that is positioned within the space formed outside of the insertion pathway.

In accordance with yet another embodiment, there has now been provided a female electrical terminal comprising a connection section for connection to a conducting wire and a contact section comprising a first tubular portion having an entrance for guiding a complementary male terminal into the contact section, and a second tubular portion between the first tubular portion and the connection section. An external opening is formed in the contact section and spaced apart from the firs tubular portion entrance. A single flexible contact element is at least partially disposed within the contact section for urging an inserted complementary male terminal into engagement with an inner wall of the contact section. The contact element includes a leading edge that extends through the external opening.

The present invention also provides electrical connectors comprising improved female electrical terminals. In accordance with one embodiment, there has now been provided an electrical connector comprising a housing including a passage extending through it, and an opening formed in a face of the housing for providing access to the passage. A female electrical terminal is at least partially disposed within the passage. The female electrical terminal comprises a connection section for connection to a conducting wire and a contact section comprising a first tubular portion having an entrance for guiding a complementary male terminal into the contact section which has been inserted into the housing opening, and a second tubular portion between the first tubular portion and the connection section. An external opening is formed in the contact section and spaced apart from the entrance. A single flexible contact element is at least partially disposed within the contact section for urging an inserted complementary male terminal into engagement with an inner wall of the contact section. The contact element includes a leading edge that extends through the external opening.

These and various other features of novelty, and their respective advantages, are pointed out with particularity in the claims annexed hereto and forming a part hereof.

BRIEF DESCRIPTION OF THE DRAWINGS

The present invention is believed to be best understood through the following detailed description of preferred embodiments and the accompanying drawings wherein like reference numbers indicate like features, and wherein.

DETALIED DESCRIPTION OF THE PREFERRED EMBODIMENTS

Figure 9:
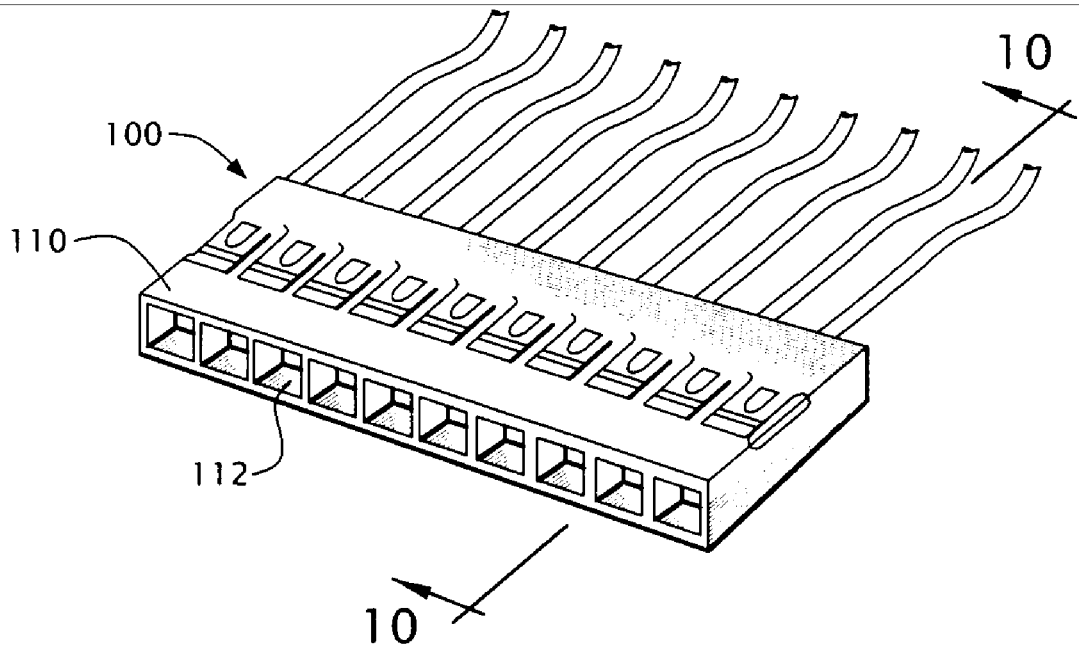
FIG. 9 is a perspective view of an electrical connector embodiment provided by the present invention.
Figure 10:
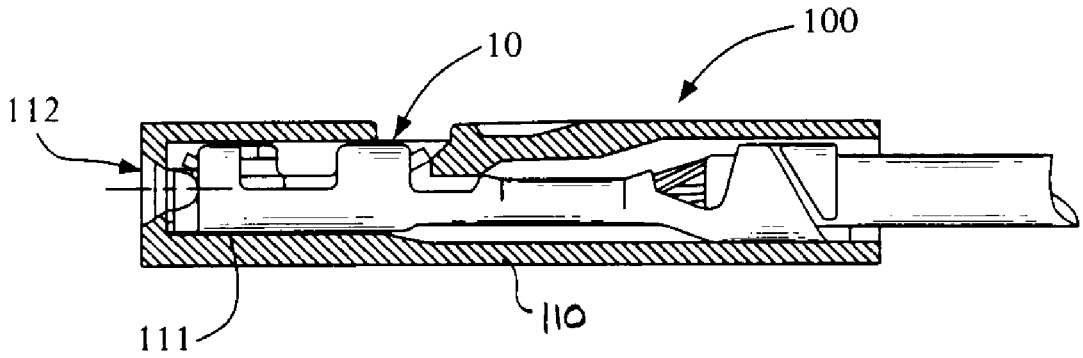
FIG. 10 is a cross-sectional view of the electrical connector taken along line X-X in FIG. 9.

Referring to the drawings and the preferred embodiment in greater detail, and particularly to FIGS. 4 to 8, female electrical terminal 10 includes a connection section 20 for connection to a conducting wire (an example of which is shown in FIGS. 9 and 10) and a contact section 30 for engaging a complementary male terminal (not shown). It should be noted that while the preferred embodiment depicts the conducting wire in-line with the contact section 30, other arrangements are possible. For example, a right-angle connector is possible where the conducting wire is transverse to the contact section 30. Contact section 30 preferably comprises two tubular-shaped portions, first tubular portion 90 and second tubular portion 96, that are preferably arranged end to end. One of ordinary skill in the art would readily appreciate that the tubular nature of contact section 30 is capable of taking many geometric forms, and being made by a varying number of walls or like structure. Accordingly, the illustrated and described embodiments are not limiting.

First tubular portion 90 comprises first sidewalls 91*a* and 91*b* that have been converged to form a tubular enclosure, and an entry portion 11 having an entrance 70 for guiding a complementary male terminal into contact section 30. First tubular portion 90 has an effective inner diameter ID1 and an effective outer diameter OD1. Effective diameter means the diameter of a circle that either circumscribes the referenced element (effective outer diameter), or is inscribed by the referenced element (effective inner diameter). Second tubular portion 96 comprises second sidewalls 97*a* and 97*b* that, in a preferred embodiment, are longer than sidewalls 91*a* and 91*b*. Second tubular portion 96 has an effective inner diameter ID2 and an effective outer diameter OD2.

A flexible contact element 40 is at least partially disposed within contact section 30 for urging a complementary male terminal into engagement with a contact section inner wall, such as bottom wall 31. In a preferred embodiment, contact element 40 is arcuate-shaped, having its apex 41 directed towards bottom wall 31. The distance D between apex 41 and bottom wall 31 is designed to be smaller in dimension than the diameter of the complementary male terminal. Upon insertion of a male terminal, flexible contact element 40 will accordingly be displaced upwardly, thereby creating reactionary normal forces directed to portions of the male terminal sufficient to maintain inter-engagement and electrical connectivity between the male and female terminals. The required amount of applied forces may vary, and can be adjusted by altering any one or combination of the following variables: distance D; material properties of the complementary male terminal, such as surface roughness; and material properties of flexible contact element 40, such as thickness, surface characteristics, thermal treatment, material composition and the like.

Protecting flexible contact element 40 from damage is an important aspect of the present invention. Minimally, damage to contact element 40 results in a non-reliable electrical connection between the inter-engaged terminals. In a worse case scenario, contact element 40 can be damaged and distorted to the extent that it becomes separated from contact section 30. Without the contact element 40, female terminal 10 will fail. Female terminals and electrical connectors comprising the same, as provided by the present invention, are useful in a variety of important electronic devices where loss of signal pass-through can be extremely detrimental. The present invention provides a robust and functional terminal design that at least decreases the potential for damage to contact element 40 and associated loss of signal.

Figure 1:
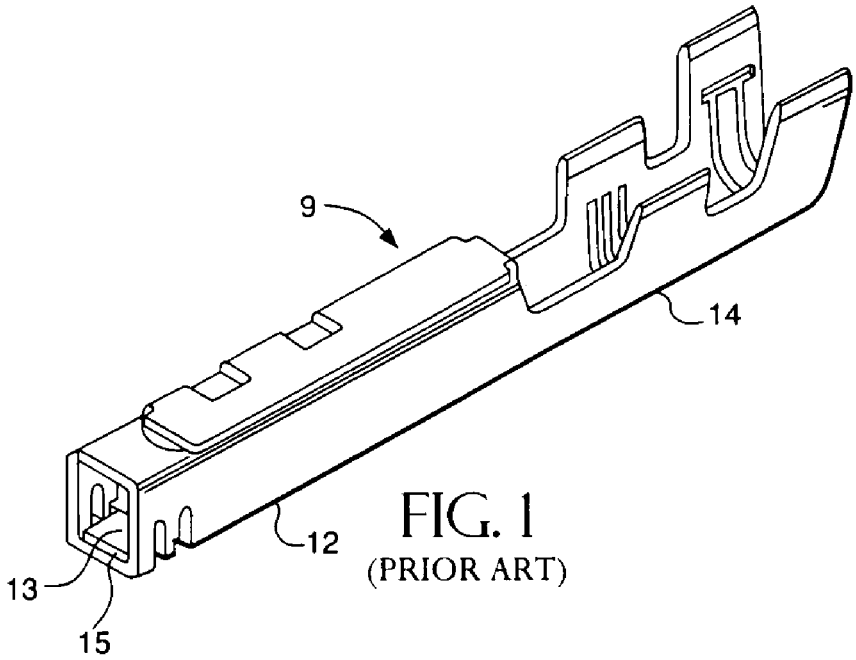
FIG. 1 (PRIOR ART)
FIG. 1 is a perspective view of a prior art female electrical terminal.
Figure 2:
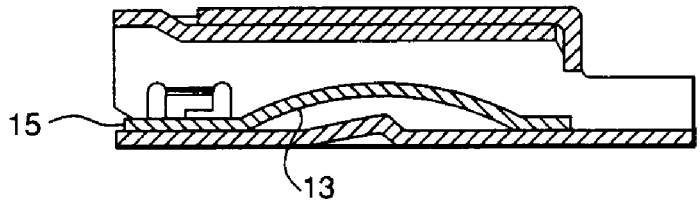
FIG. 2 (PRIOR ART)
FIG. 2 is a partial cross-sectional view of the terminal in FIG. 1.
Figure 3:
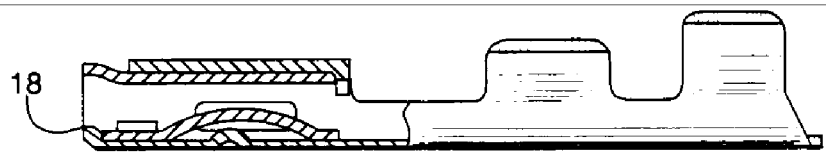
FIG. 3 (PRIOR ART)
FIG. 3 is a cutaway view of another prior art female electrical terminal.
Figure 4:
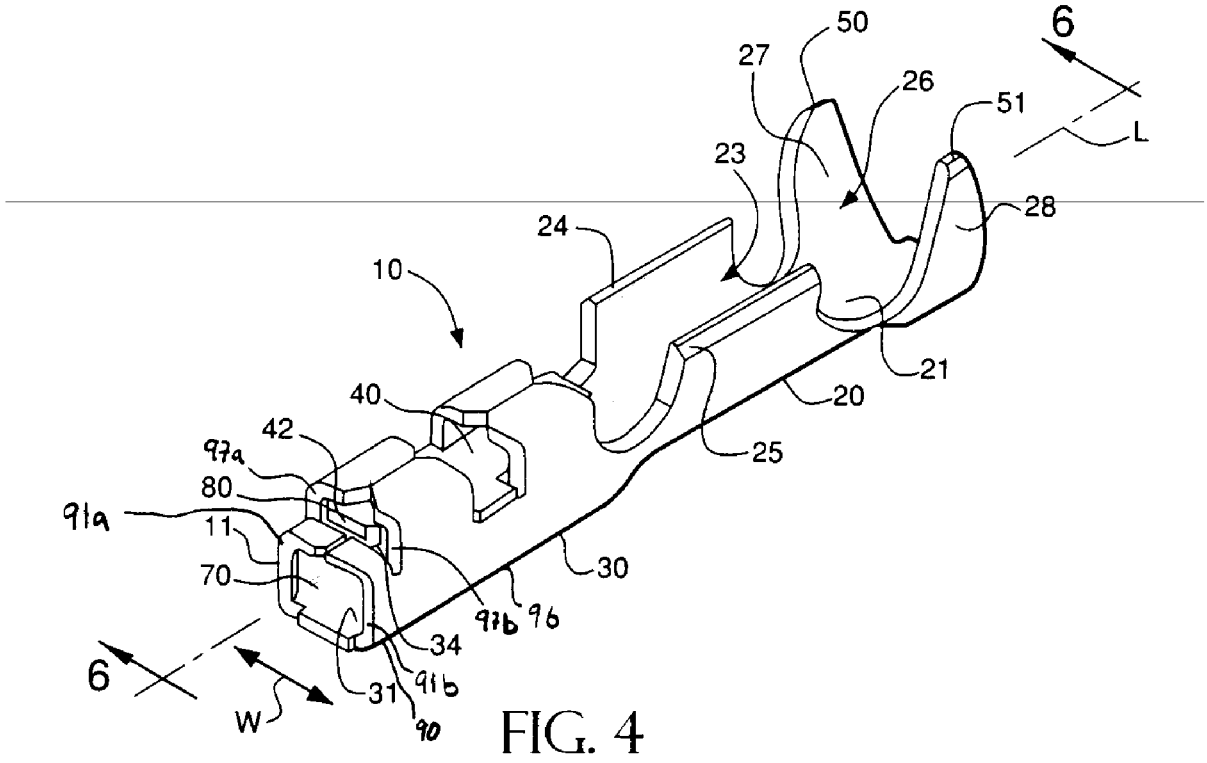
FIG. 4 is a perspective view of a female electrical terminal embodiment provided by the present invention.
Figure 5:
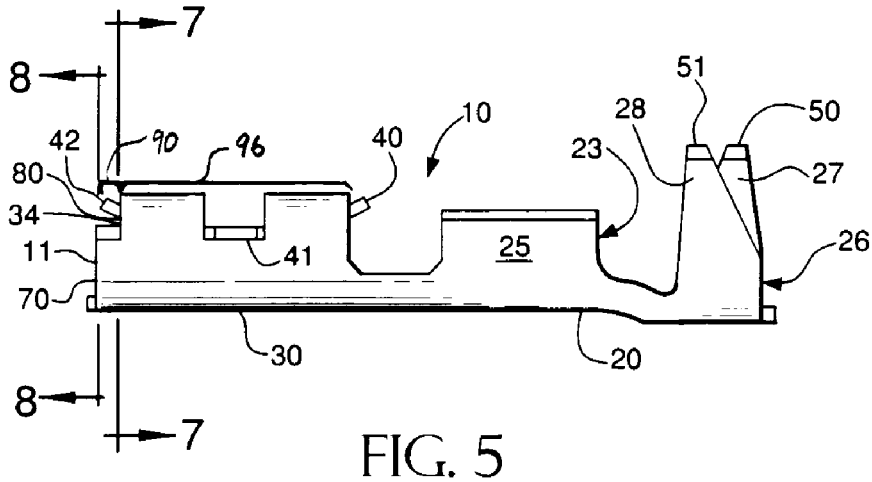
FIG. 5 is a side view of the female electrical terminal in FIG. 4.
Figure 6:
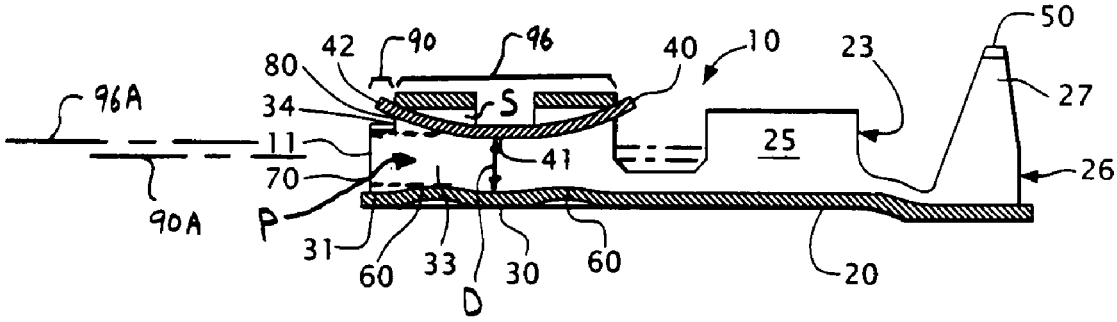
FIG. 6 is a cross-sectional view of the female electrical terminal taken along line VI-VI in FIG. 4.
Figure 7:
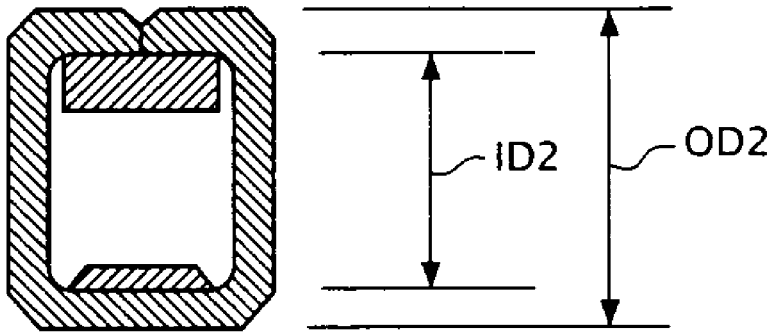
FIG. 7 is a partial cross-sectional view of the female electrical terminal taken along line VII-VII in FIG. 5.
Figure 8:
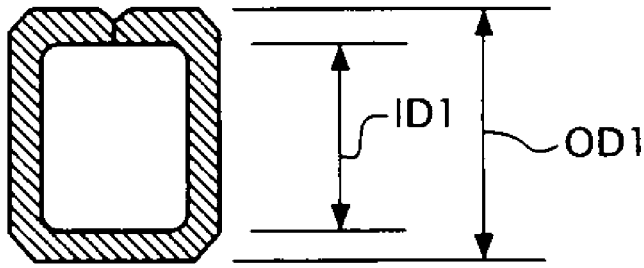
FIG. 8 is an opposing cross-sectional view of the female electrical terminal taken along line VIII-VIII in FIG. 5.

Damage can have numerous sources, including engaging misaligned terminals and through tampering. Generally, initiation of the damage is through application of force to the contact element's leading edge 42. Accordingly, the present invention prohibits access to leading edge 42. As can be seen in FIG. 6, first tubular portion 90 forms an insertion pathway P for a complementary male terminal that extends from entrance 70 and into the second tubular portion 96 of contact section 30. A space S exists outside the periphery of insertion pathway P, and correspondingly entrance 70. One way of creating space S is by misaligning central axes of the first and second tubular portions 90 and 96. That is, a central axis 90A of first tubular portion 90 is offset from a central axis 96A of second tubular portion 96. By positioning the contact element's leading edge 42 within space S, that is, outside of insertion pathway P, access to leading edge 42 is prohibited. Thus, an initially misaligned male terminal would be directed into pathway P and away from leading edge 42.

To further protect contact element 40, leading edge 42 is preferably extended through space S and positioned external to contact section 30. This can be accomplished by employing an external opening 80 within contact section 30, including, within either first tubular portion 90 or second tubular portion 96. Alternatively, and in a preferred embodiment, opening 80 is formed at the interface between the two tubular portions 90, 96. As can bee seen in the figures, front end 34 of second tubular portion 96 extends beyond the periphery of first tubular portion 90 (entry portion 11). This extension forms opening 80, which is capable of receiving contact element 40 and its leading edge 42.

The non-coextiveness that forms opening 80 at the interface of the first and second tubular portions 90, 96 may be perfected through a number of techniques, including offsetting similarly sized and shaped portions. Preferably, first and second tubular portions are sized differently, as is shown in the figures. By way of example, effective inner and outer diameters ID1, OD1 of first tubular portion 90 are smaller than the effective inner diameter ID2 of second tubular portion 96.

Additional features of female terminal 10 will now be described. Projections extending from a contact section inner surface may be employed to improve electrical contact and retention of an engaged complementary male terminal. Retentive normal forces are concentrated at these projections. By way of example, raised elements 60 are disposed on the inner surface of bottom wall 31.

The depicted in-line connection section 20 includes a wire barrel 23 for cradling an inserted conducting wire (such as that shown in FIG. 10). Wire barrel 23 has wire crimp arms 24 and 25 that are capable of being crimped onto the conducting wire, thereby making an electrical connection between female terminal 10 and the conducting wire. Connection section 20 may also include an insulation barrel 26 for cradling insulation or other sheathing material that may be surrounding the conducting wire. Insulation barrel 26 is shown having insulation crimp arms 27 and 28 that are capable of being formed around wire sheathing. In a preferred embodiment, insulation crimp arms 27 and 28 have tapered ends 50 and 51 and a length that is greater than half of the width W of connection section 20. In addition, tapered ends 50 and 51 are preferably offset along a longitudinal axis L. This preferred arm length and offset arrangement provides for substantial overlap around a sheathed conducting wire, thereby ensuring a sufficient grip on the conducting wire to eliminate any potential for separation from the female terminal.

Once again, while connecting section 20 in the preferred embodiment is depicted as in-line with respect to contact section 30, it is equally possible for the entire connector to be a right-angle connector in which the connecting section 20 is transverse with respect to the contact section 30.

Terminals of the present invention are preferably made from a base material comprising brass, which is plated with a material such as gold. The flexible contact element is preferably made from a base material including beryllium, copper, and alloys made from the same. Similar to the terminal body members, the flexible contact element may be plated with a suitable material, such as gold.

The materials and terminal components of the present invention may optionally be processed or treated to impart improved functionality. For example, pre-formed sections may be heat-treated to increase their ductility, which will make forming the sections into their final configuration much easier. Another example is knurling surfaces of the sectional elements, such that a better grip may be maintained on inserted terminals and conducting wires.

Terminal components and the flexible contact elements of the present invention may be made by any of the methods known to persons having ordinary skill in the art. One known method includes stamping and forming from sheet material, wherein the formation of multiple sections and elements is done through progressive dies to impart the final terminal and contact element configurations.

The present invention also provides electrical connectors, particularly receptacles, comprising female terminals similar to those shown in FIGS. 4-8 and described above. Referring now to FIGS. 9 and 10, receptacle 100 includes a housing 110 having a plurality of passages 111 and a plurality of openings 112 communicating with passages 111. A single female terminal 10 is disposed in each of passages 111. A complementary male connector (not shown) can be connected to receptacle 100 by inserting male terminals (not shown) through openings 112 and into female terminal contact sections 30.

Receptacle 100 is preferably formed with thermoplastic materials using injection molding techniques. Suitable materials include polyphenylene sulfide, polymethylencecyclohexane terephthalate, liquid crystal polymer, polyphthalamide, nylon 4,6, polyesters and polyolefins. After housing 110 is molded, terminals 10 are inserted and secured in passageways 111. Alternatively, housing 110 may be molded around the terminals to form the electrical connector in a single step. The present invention, however, is not limited to such materials and manufacturing methods, but rather encompasses any material and related methods for forming the same, such as, for example, metallic castings, fabrications, and combinations thereof.

It is to be understood that even though numerous characteristics and advantages of the present invention have been set forth in the foregoing description, together with details of the structure and function of the invention, the disclosure is illustrative only. Accordingly, changes may be made in detail, especially in matters of shape, size and arrangement of features within the principles of the invention to the full extent indicated by the broad general meaning of the terms in which the appended claims are expressed.

What is claimed is:

1. A female electrical terminal, comprising:

a contact section for mating with a complementary male terminal, the contact section including a bottom wall; a first set of walls that define a first closed tubular portion with the bottom wall; and a second set of walls that define a second closed tubular portion with the bottom wall, the second closed tubular portion arranged end to end with the first closed tubular portion, the first closed tubular portion having an effective diameter that is less than an effective diameter the second closed tubular portion, the first closed tubular portion defining an insertion pathway for the male terminal; and a flexible contact element at least partially disposed within the contact section and retained by the contact section so that opposing freestanding ends of the flexible contact element can move in relation to the contact section, the flexible contact element for urging the complementary male terminal into engagement with the bottom wall, wherein the flexible contact element does not extend into the first closed tubular portion and the first set of walls is positioned between one of the freestanding ends of the flexible contact and the insertion pathway.

2. The female electrical terminal of claim 1, wherein the flexible contact element includes a leading edge that is positioned in its entirety outside of the contact section.

3. The female electrical terminal of claim 1, wherein the flexible contact element includes a leading edge, and wherein the female electrical terminal is devoid of any structure prohibiting frontal access to the flexible contact element leading edge.

4. A female electrical terminal, comprising:

a contact section for mating with a complementary male terminal, the contact section including a first closed tubular portion comprising a first set of walls that forms an insertion pathway for a complementary male terminal; and a second closed tubular portion comprising a second set of walls and being arranged end to end with the first closed tubular portion; wherein geometrically central axes of the first and second closed tubular portions are misaligned such that a space is formed outside of the insertion pathway; and a flexible contact element at least partially disposed within the contact section for urging the complementary male terminal into engagement with the bottom wall, the flexible contact element including a freestanding leading edge that is positioned within the space and is separated from the insertion pathway by the first set of walls.

5. The female electrical terminal of claim 4, wherein the female electrical terminal is devoid of any structure prohibiting frontal access to the flexible contact element leading edge.

6. The female electrical terminal of claim 4, wherein an opening is defined at an interface between the first closed tubular portion and the second closed tubular portion; and wherein a portion of the flexible contact element extends into the opening.

7. A female electrical terminal, comprising:

a contact section for mating with a complementary male terminal, the contact section including a first closed tubular portion comprising a first set of walls that forms an insertion pathway for a complementary male contact; and a second closed tubular portion comprising a second set of walls and being arranged end to end with the first closed tubular portion; wherein the first closed tubular portion has an effective diameter that is a different size than that of the second closed tubular portion such that a space is formed outside of the insertion pathway; and a flexible contact element at least partially disposed within the contact section for urging a complementary male terminal into engagement with the bottom wall, the flexible contact element including a freestanding leading edge that is positioned within the space on an opposite side of the first set of walls from the insertion pathway.

8. The female electrical terminal of claim 7, wherein the female electrical terminal is devoid of any structure prohibiting frontal access to the flexible contact element leading edge.

9. A female electrical terminal, comprising:

a contact section including a set of converging walls that define an insertion pathway for a complementary male terminal, the insertion pathway having a diameter that is smaller than a closed tubular portion that is proximate the set of converging walls; and a flexible contact element partially disposed within the contact section and retained by the contact section so that opposing freestanding ends of the flexible contact element can move in relation to the contact section, the flexible contact element for urging a complementary male terminal into engagement with a contact section bottom wall;

wherein the female electrical terminal is devoid of any structure prohibiting frontal access to a leading edge of the flexible contact element, and wherein the flexible contact element does not extend into the set of converging walls and one of the freestanding ends of the flexible contact element is isolated from the insertion pathway by the set of converging walls.

* * * * *